US008796525B2

(12) United States Patent
Sawhney

(10) Patent No.: US 8,796,525 B2
(45) **Date of Patent: *Aug. 5, 2014**

(54) MUSICAL INSTRUMENT STAND

(75) Inventor: Ravi K. Sawhney, Calabasas, CA (US)

(73) Assignee: RKS Ventures, LLC, Thousand Oaks, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/006,207

(22) Filed: Jan. 13, 2011

(65) Prior Publication Data

US 2011/0107897 A1 May 12, 2011

Related U.S. Application Data

(60) Division of application No. 12/419,199, filed on Apr. 6, 2009, now abandoned, which is a continuation of application No. 11/588,625, filed on Oct. 27, 2006, now Pat. No. 7,514,616.

(60) Provisional application No. 60/760,827, filed on Jan. 19, 2006.

(51) Int. Cl.
*G10D 9/00* (2006.01)

(52) U.S. Cl.
USPC ..... 84/453

(58) Field of Classification Search
USPC ..... 84/327, 453; 248/443
See application file for complete search history.

(56) References Cited

U.S. PATENT DOCUMENTS 3,057,591 A 10/1962 Weimer
5,973,244 A * 10/1999 McCulloch ..... 84/327
6,091,008 A 7/2000 Yu
6,397,439 B1 6/2002 Langford
6,533,228 B1 3/2003 Yu
6,576,822 B1 6/2003 Grace
6,585,199 B1 7/2003 Yu
6,590,764 B2 7/2003 Silverstein
D482,904 S 12/2003 Slaymaker
6,722,617 B2 4/2004 Wilfer
6,772,981 B1 8/2004 Yu
6,835,883 B2 12/2004 Stevens
6,881,884 B2 4/2005 Hsieh
6,953,222 B2 10/2005 Larrick et al.
6,982,373 B1 1/2006 Yu
7,002,066 B2 2/2006 Yu
7,074,993 B1 7/2006 Hsieh
7,105,732 B1 9/2006 Hsieh
7,208,666 B2 4/2007 Burch et al.
7,232,098 B2 6/2007 Rawlings et al.

(Continued)

*Primary Examiner* — Jianchun Qin

(74) *Attorney, Agent, or Firm* — Hall Estill Attorneys at Law; Daniel P. Dooley

(57) ABSTRACT

A musical instrument stand is disclosed that includes at least, a pair of legs pivotally secured to a support portion and disposed within a leg retention channel of the support portion when the support portion is in a closed position, and extracted from the leg retention channel when the support portion is in an open position. Preferably, the support portion includes at least a position stop that limits the extent that each the open and closed positions of the support portion may attain. The musical instrument stand further preferably includes an over center latch assembly interposed between and communicating with the pair of legs, the over center latch maintains a predetermined separation between said first and second legs when the over center latch assembly is in a locked position, and nests within the pair of legs when the pair of legs are disposed within a leg retention channel.

14 Claims, 7 Drawing Sheets

(56) References Cited

U.S. PATENT DOCUMENTS

| | | | | |
|---|---|---|---|---|
| 7,296,653 | B1 | 11/2007 | Smith, Jr. et al. | |
| D557,329 | S * | 12/2007 | Lippert | D17/20 |
| 2002/0088914 | A1 * | 7/2002 | Yu | 248/434 |
| 2004/0056166 | A1 | 3/2004 | Harrison | |
| 2004/0237755 | A1 | 12/2004 | Laio | |
| 2005/0016354 | A1 | 1/2005 | Kent | |
| 2005/0121567 | A1 | 6/2005 | Meuniot | |
| 2006/0186303 | A1 | 8/2006 | Phifer et al. | |
| 2007/0068362 | A1 | 3/2007 | Bordignon | |

* cited by examiner

MUSICAL INSTRUMENT STAND

RELATED APPLICATIONS

This application is a divisional of U.S. patent application Ser. No. 12/419,199 filed Apr. 6, 2009 entitled, "MUSICAL INSTRUMENT STAND," now abandoned, which is a continuation of U.S. patent application Ser. No. 11/588,625 filed Oct. 27, 2006 entitled, "MUSICAL INSTRUMENT STAND," now U.S. Pat. No. 7,514,616, issued Apr. 7, 2009, which claims priority to U.S. Provisional Patent Application No. 60/760,827 filed on Jan. 19, 2006, entitled "COLLAPSIBLE SUPPORT."

FIELD OF THE INVENTION

The present invention relates generally to the field of mechanical supports and more particularly, but without limitation, to a collapsible support configured to support a substantially planar member, such as an electric guitar, an electric bass guitar, or the like.

BACKGROUND

Mechanical supports are used in a variety of applications to provide mechanical support to a member. For example, musicians of stringed instruments such as guitars often find it desirable to utilize an instrument stand to temporarily support an instrument when the instrument is not in use. This safeguards the instrument during a break, yet allows ready access to the instrument when needed again. An instrument stand further generally eliminates the need to retrieve the instrument from an instrument case during such interludes.

While a variety of mechanical supports have been proposed in the art, there remains a continual need for improved designs that are sturdy, lightweight and portable. It is to these and other improvements that preferred embodiments of the present invention are generally directed.

SUMMARY OF THE INVENTION

In accordance with a preferred embodiment, a musical instrument stand that includes at least, a pair of legs pivotally secured to a support portion and disposed within a leg retention channel of the support portion when the support portion is in a closed position, and extracted from the leg retention channel when the support portion is in an open position is provided. The support portion preferably further includes at least a position stop that limits the extent that each the open and closed positions of the support portion may attain, and an over center latch assembly interposed between and communicating with the pair of legs. Preferably, the over center latch maintains a predetermined separation between said first and second legs when the over center latch assembly is in a locked position. The over center latch assembly preferably includes at least a first latch member that nests within a second latch member, and further nests within the pair of legs when pair of legs are disposed within a leg retention channel.

In a preferred embodiment, the support portion includes at least a first stop feature provided by a first arm of the support portion; and a second stop feature provided by a second arm of the support portion. The first and second stop members preferably each include corresponding closed position projections that interact with one another to establish the predetermined configuration of the support portion when the support portion is in the closed position, and corresponding open position surfaces that interact with one another to establish the predetermined configuration of the support portion, when the support portion is in the open position. In a preferred embodiment, the first and second stop features collectively form the position stop.

Preferably, the first and second arms each provide an interlocking hinge portion interacting with one another for rotation of each arm relative to the other, when a hinge pin interacting with the interlocking hinge portions joins the arms together such that each arm rotates about said hinge pin.

In an alternate preferred embodiment, a method of assembling a musical instrument stand includes at least the steps of, providing a first arm and a second arm of a support portion, wherein each arm includes an interlocking hinge portion. The interlocking hinge portions are merged one to the other to form a retention portion, such that a first stop feature of the first arm and a second stop feature of the second arm interact to form a position stop of the support portion. With the interlocking hinge portions merged together, a hinge pin is inserted into hinge pin apertures of the merge interlocking hinge portions to rotationally secure the first and second arms together.

With the first and second arms rotationally pinned together, a first leg is secured to the first arm using a first pivot restraint, and a second arm is secured to the second arm using a second pivot restraint, such that each the first and second arms rotate relative to their corresponding first and second legs. With the arms secured to their corresponding legs, a first latch member is secured to a second latch member through use of a latch pin to form an over center latch assembly.

The over center latch assembly is disposed between and interacts with the first and second legs. Each leg includes an over center latch receptacle for receipt of the over center latch. With the formation of the over center latch assembly, the first latch member is snapped into rotational communication with the latch receptacle of the first leg, and the second latch member is snapped into rotational communication with the latch receptacle of the second leg. By depressing said over center latch, the first and second legs are constrained in an instrument support position.

These and various other features and advantages which characterize the claimed invention will be apparent from reading the following detailed description and a review of the associated drawings.

DESCRIPTION OF THE PREFERRED EMBODIMENTS

Before explaining the present invention in detail, it is important to understand that the invention is not limited in its application to the details of the construction illustrated, or by the steps of construction inherently present by way of illustration of the appended drawings. The invention is capable of other embodiments and of being practiced or carried out in a variety of ways. It is to be understood that the phraseology and terminology employed herein is for the purpose of description to enhance an understanding by those skilled in the art and does not impose limitation on the present invention.

Additional information concerning the presently preferred embodiments of the present invention can be found in the attached sheets of drawings and accompanying text thereon.

Figure 1:
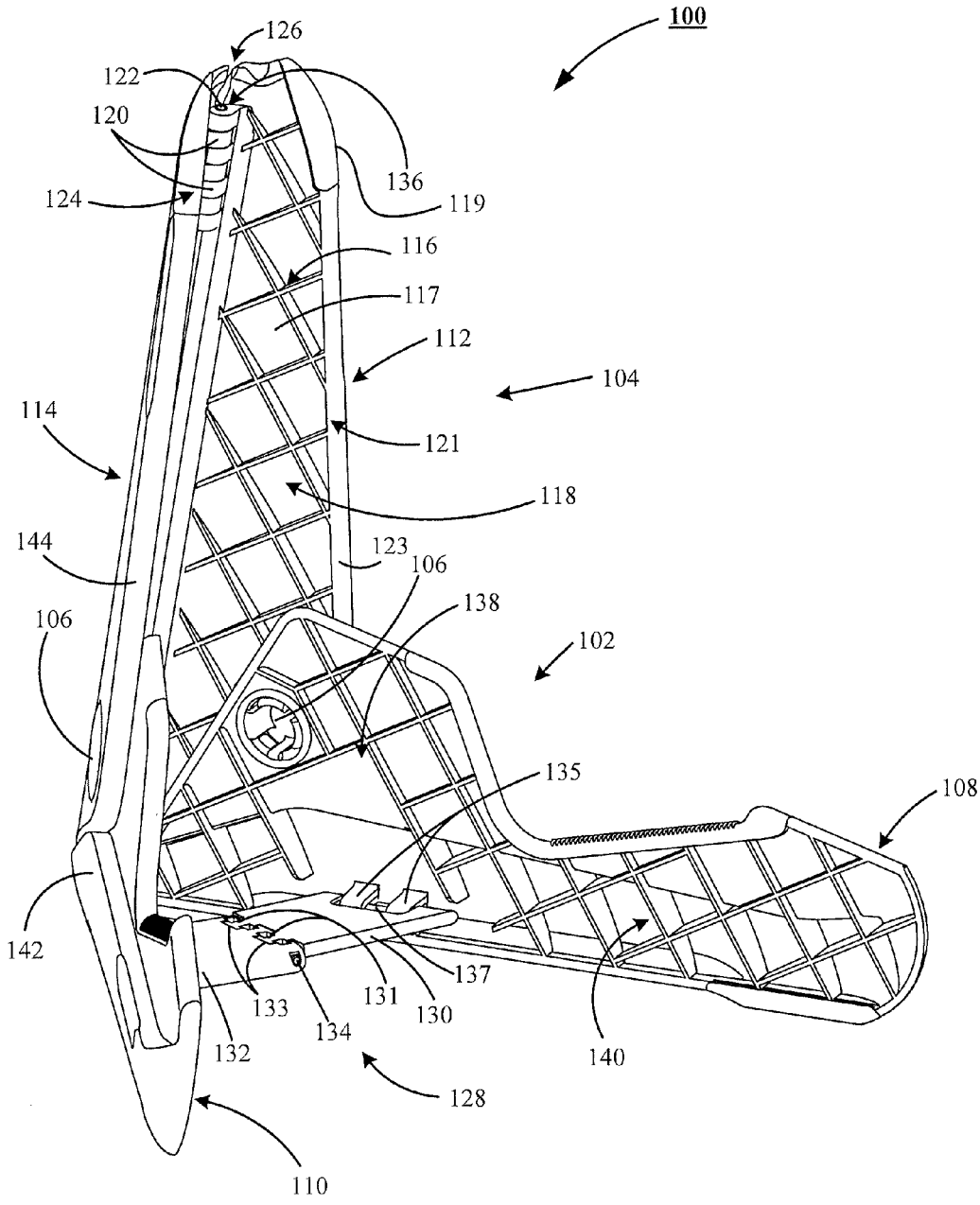
FIG. 1 shows a perspective view of an inventive musical instrument stand in a fully open and stable position, ready for receipt of a musical instrument.

Referring now to the drawings, and in particular to an example of a preferred embodiment of the present inventive musical instrument stand 100 as shown in FIG. 1. In a preferred embodiment, the inventive musical instrument stand 100 includes a base portion 102 pivotally attached to a support portion 104 by a pair of pivot restraints 106. The base portion 102 preferably includes a first leg 108 and a second leg 110, and the support portion 104 preferably includes a first arm 112 and a second arm 114.

Preferably, the first arm 112 and the second arm 114 each include at least a baffled matrix support structure 116, which establishes a predetermined configuration of each respective arm, and defines an inner wall of the leg retention channel 118. The predetermined configuration of each respective axis is a concave inner surface 117, and a convex outer surface 119, with a main body portion 121 disposed therebetween. The concave inner surface 117, the convex outer surface 119, and the main body portion 121 collectively form an edge surface 123 that encloses the perimeter of each of the respective arms 112 and 114. The first and second arms 112, 114 each include an interlocking hinge portion 120 that, with the inclusion of a first hinge pin 122, interacts with one another to form a retention portion 124, also referred to herein as hinge 124. When the first and second arms 112, 114 are merged together, a hinge pin aperture 136 is formed for receipt of the first hinge pin 122.

As described in greater detail during the discussion of FIG. 6 below, the first arm 112 and the second arm 114 collaborate to form a position stop 126, which limits the extent to which the support portion 104 can be placed in a fully open position, or a fully closed position.

FIG. 1 further shows the preferred embodiment of the present inventive musical support stand 100 includes an over center latch assembly 128. The over center latch assembly 128 preferably includes a first latch member 130 secured to a second latch member 132 by a latch pin 134. When the over center latch assembly 128 is depressed, i.e., placed in a locked position, the first leg 108 and the second leg 110 are securely held at a predetermined distance from one another to provide stability to the inventive musical instrument stand 100 in preparation for receipt of the musical instrument, such as an electric guitar.

Figure 2:
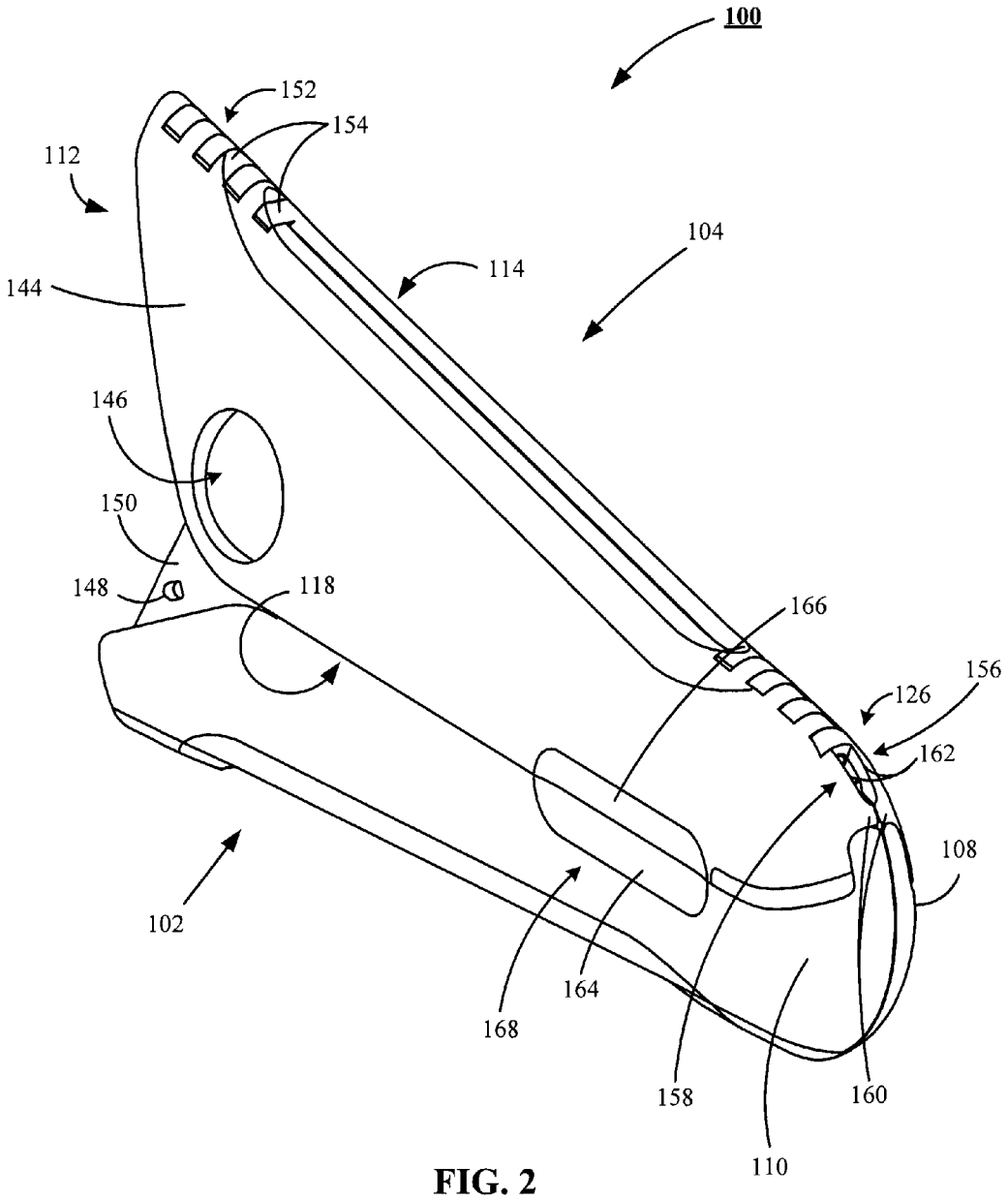
FIG. 2 shows a perspective view of the inventive musical instrument stand of FIG. 1 in a fully closed position, with a pair of leg portions disposed within a pair of support portions.

Preferably, the second latch member 132 is configured to accommodate the nesting of the first latch member 130 within the second latch member 132 when the support portion 104 is in a fully closed position, and the legs 108 and 110 are disposed within the leg retention channel 118 (as shown by FIG. 2). To accommodate the over center latch assembly 128, when the support portion 104 is in a fully closed position, each leg 108 and 110 preferably provides a latch reception channel 138, which accommodates the nesting of the over center latch assembly 128 within the support portion 104, when the support portion 104 is in a fully closed position, i.e., the legs 108 and 110 are disposed within the leg retention channel 118.

The preferred embodiment of FIG. 1 additionally shows that the first latch member 130 includes male hinge members 131 that interact with female hinge members 133 of the second latch member 132 for receipt of the latch pin 134 to form the over center latch assembly 128. Also preferably each leg 108, 110 provides a pair of female latch securement members 135, configured to interact with a corresponding male latch attachment member 137 (provided by each latch member 130, 132) to secure the over center latch assembly 128 to each leg 108, 110, when each male latch attachment member 137 is snapped into its corresponding pair of female latch securement members 135.

The first leg 108 and the second leg 110 each include at least a second baffled matrix support structure 140, which support respective external leg shells 142 (only one shown). Similarly, the baffled matrix support structures 116 of the arms 108 and 110 support respective external arm shells 144 (only one shown).

As can be seen by FIG. 2, each external arm shell 144 (only one shown) provides a pivot aperture 146 configured for the receipt of the pivot restraint 106 (of FIG. 1). Furthermore, FIG. 2 shows the external leg shells 142 and the external arm shells 144 preferably each provide concave surfaces and edges that are contoured. Preferably, the musical instrument stand is formed from a polymer such as polycarbonate, and is available in a range of colors. It is noted however, the use of polycarbonate as material for constructing the inventive musical instrument stand does not impose any limitations on the present invention. Those skilled in the art understand a range of materials may be used in place of polycarbonate to achieve substantially the same advantages and characteristics inherent with the use of polycarbonate. Among those materials are: carbon fiber composites, fiberglass composites, coated metals, and even wood.

In the preferred embodiment, the use of a polycarbonate material, in conjunction with the concave surfaces and contoured edges of the respective external arm shells 144 and external leg shells 142 present an external surface specifically configured for the minimization of marring and scratches on instruments supported by the inventive musical instrument stand 100. It has further been found that the inventive musical stand 100 may be conveniently carried within an instrument carrying case without imparting scratches or a mars onto the instrument contained within the case.

FIG. 2 further shows the inventive musical instrument stand 100 includes a detent 148 provided by a detent recess 150 of each leg 108, 110 (of FIG. 1), and a second hinge 152. The second hinge 152 is formed from second interlocking hinge portions 154 provided by each arm 112 and 114, and a second hinge pin (not separately shown) securing the interlocking hinge portions 154 together. Adjacent the hinge 124, the position stop 126 includes a first stop feature 156 provided by the first arm 112, and a second stop feature 158 provided by the second arm 114. Each stop feature 156, 158 provides a closed position projection 160, which interact with one another to establish a predetermined configuration of the support portion 104, when the support portion 104 is in the closed position. Each stop feature 156, 158 further provides an open position surface 162, which interact with one another to establish a predetermined configuration of the support portion 104, when the support portion 104 is in the open position.

Figure 4:
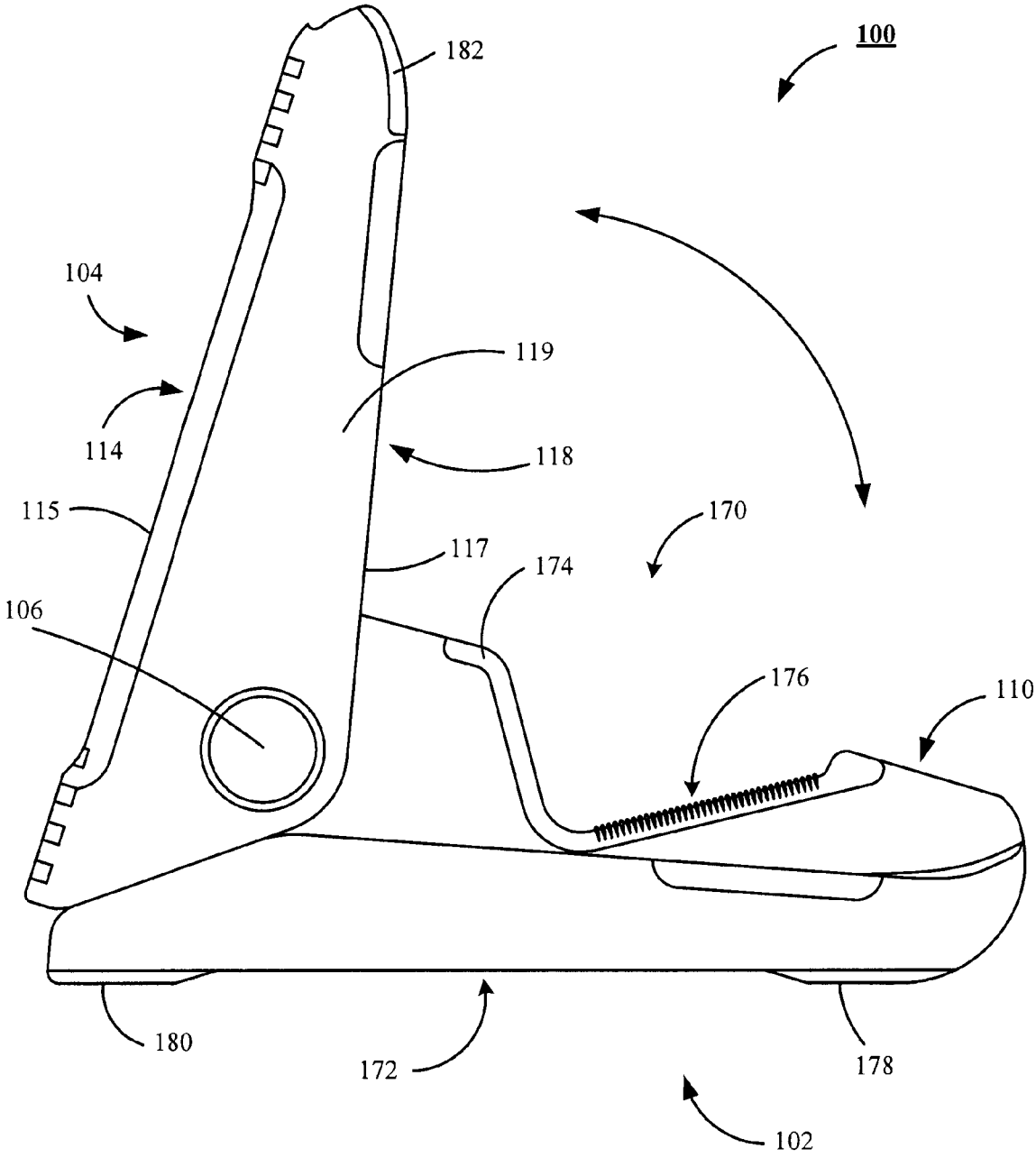
FIG. 4 shows a side elevation view of the inventive musical instrument stand of FIG. 1 in a fully open position showing the leg portions fully extracted from the support portions.

The detent 148 provided by each leg 108, 110 communicate with their respective arms 112, 114, when the legs 108, 110 are placed into a retracted position (as shown by FIG. 4) to inhibit return of the arms 112, 114 to a closed position as shown by FIG. 2. In a preferred embodiment, each leg 108, 110 provides a finger grasp indent 164, and each arm 112, 114 provides a corresponding finger grasp indent 166. In combination, the finger grasp indents 164 and 166 form a grasp region 168 for the inventive musical instrument stand 100, which allows users to easily open the musical instrument stand 100 in preparation for its use.

Figure 3:
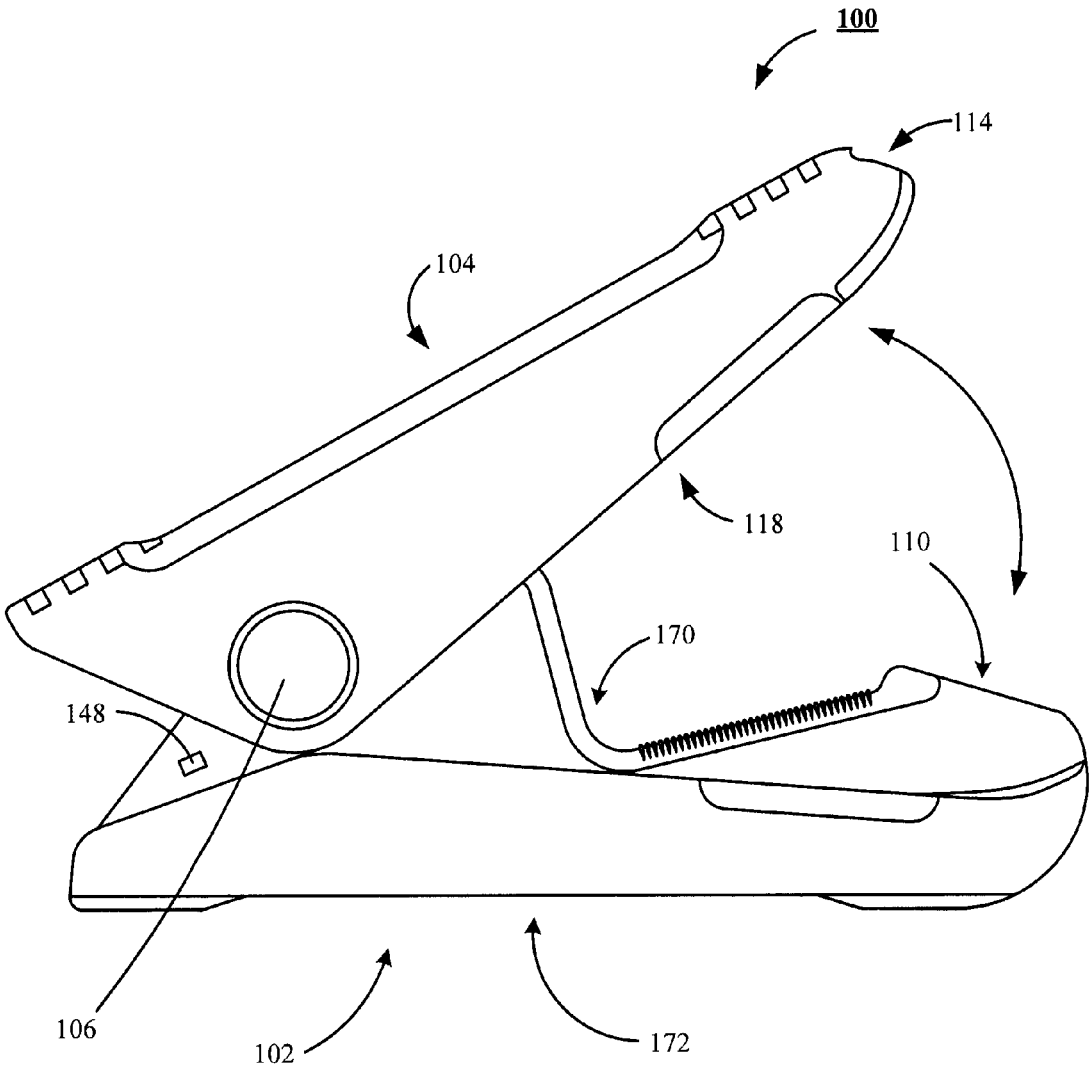
FIG. 3 shows a side elevation view of the inventive musical instrument stand of FIG. 1 in a partially open position showing the leg portions partially extracted from the support portions.

FIG. 3 shows the legs 108, 110 of the base portion 102 each include an instrument saddle portion 170 and a foot support portion 172. The saddle portions 170 of the respective legs 108 and 110 constitute the portion of the legs 108 and 110 disposed within the leg retention channel 118 (of FIG. 1) when the inventive musical instrument stand 100 is in a fully closed position as shown by FIG. 2.

FIG. 4 shows each saddle portion 170 is configured to cradle an instrument supported by the legs 108, 110, and includes an instrument grip feature 174 formed from a skid resistant, elastomeric material. Preferably, the grip feature 174 inhibits inadvertent movement of the musical instrument cradle by the saddle portion 170. In a preferred embodiment, the grip feature 174 includes a serrated surface 176 that, when communicating with a musical instrument supported by the inventive musical instrument stand 100, improves retention of a musical instrument supported by the saddle portion 170. The foot support portion 172, a first foot 178, and a second foot 180 protrude from the lower surface of each of the legs 108, 110. In a preferred embodiment, the first foot 178 and the second foot 180 are formed from a skid resistant, elastomeric material of substantially the same composition as the grip feature 174. FIG. 4 further shows that the second arm 114 additionally includes at least a proximal edge 115, a distal edge 117, and a main body portion 119 disposed between the proximal and distal edges 115, 117, wherein the pivot aperture 106 is formed in the main body portion and disposed between and in non-contacting adjacency with neither the proximal edge 115, nor the distal edge 117.

In addition to the grip feature 174, the first foot 178 and the second foot 180 provided by the foot support portion 172, each arm 112, 114 provides an instrument back retention feature 182. Preferably, each retention feature 182 is formed from substantially skid resistant, elastomeric material used in forming the first foot 178, the second foot 180, and the grip feature 174, which may be selected from a range of polymers that include at least, but are not limited to NEOPRENE®, butyl rubber, natural or synthetic latex, and polyurethane.

Figure 5:
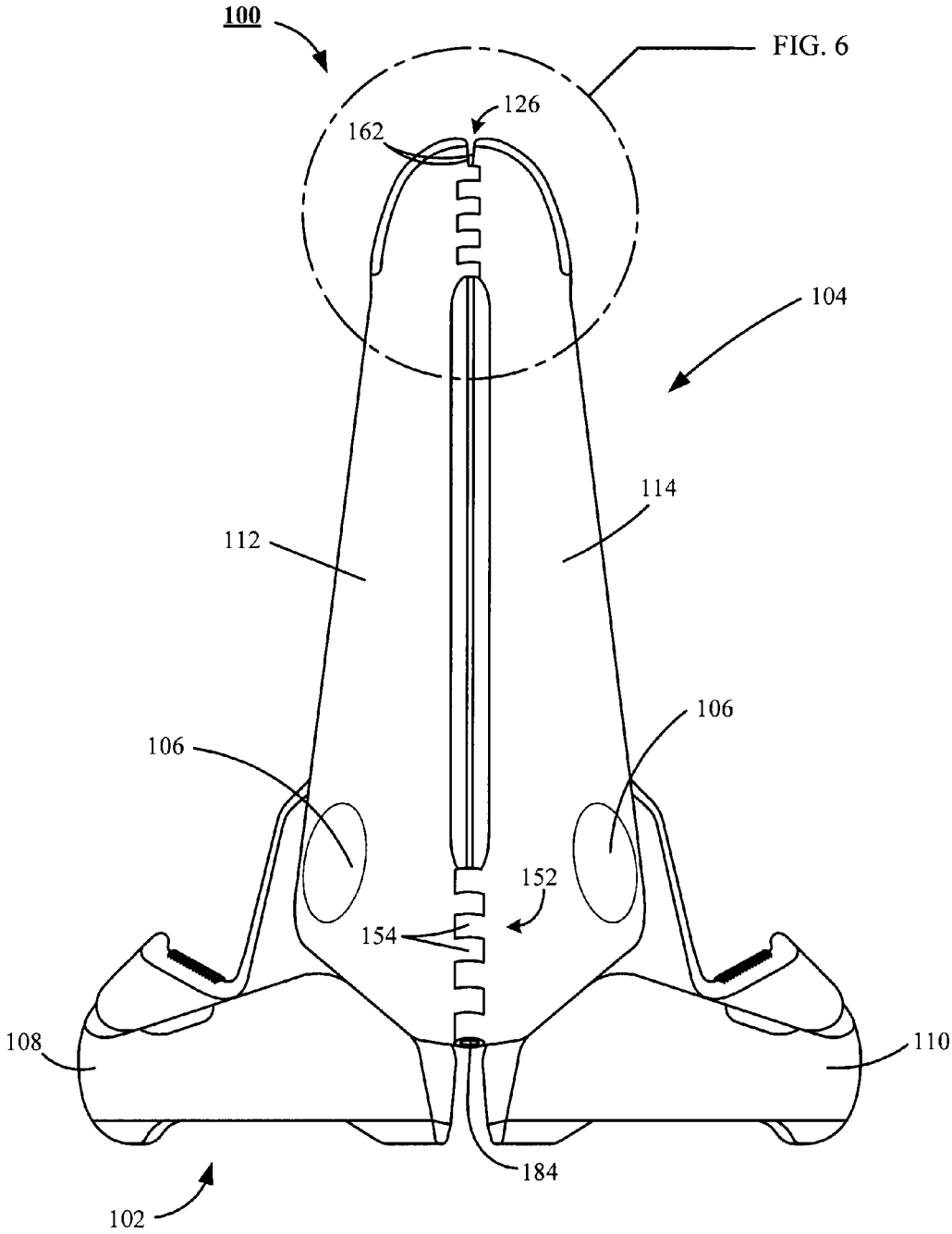
FIG. 5 shows a back elevation view of the inventive musical instrument stand of FIG. 1 in a fully open position showing the leg portions fully extended for receipt of the musical instrument.

FIG. 5 shows the second hinge 152 formed from the second interlocking hinge portions 154 provided by each arm 112 and 114, and a second hinge pin 184 securing the interlocking hinge portions 154 together. As depicted by FIG. 5, the legs 108 and 110 are positioned relative to each other and a maximum extent allowed by the over center latch assembly 128 (of FIG. 1), when the over center latch assembly 128 is in a locked configuration. When the over center latch assembly 128 is in the locked configuration, the open position surfaces 162 of the position stop 126 are adjacent one another, but not in contact with each other.

Figure 6:
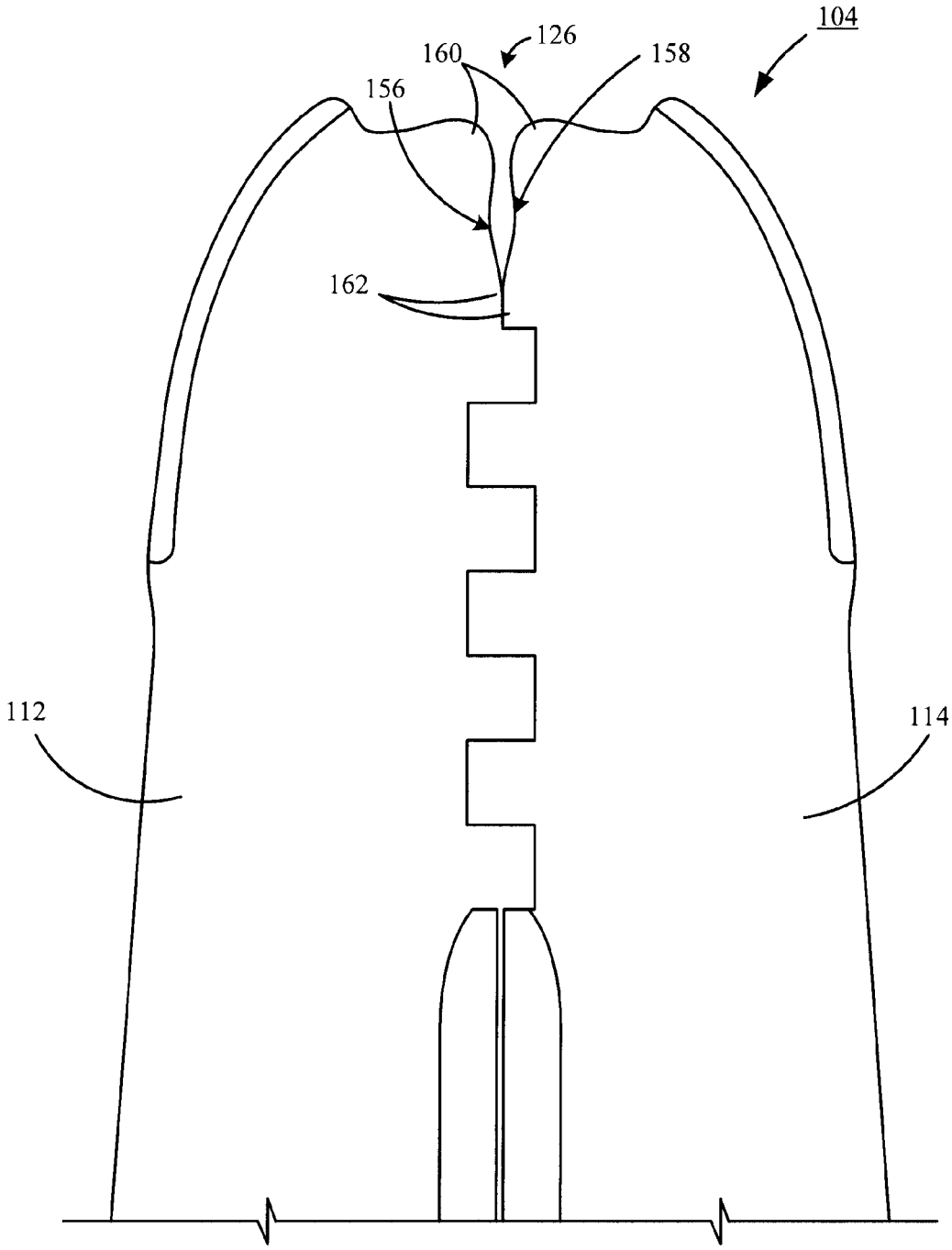
FIG. 6 shows a partial cut-away back elevation view of the inventive musical instrument stand of FIG. 1 showing a position stop that limits the extent that the pair of support portions may be opened or closed.

FIG. 6 shows the closed position projections 160 of the stop feature 156, 158 in non-contact with one another, and the open position surfaces 162 of the stop feature 156, 158 is in contact with one another. The open position surfaces 162 are provided as a safety precaution that prevents a musical instrument supported by the inventive musical instrument stand 100 from being dislodged from the inventive musical instrument stand 100, if the over center latch assembly 128 were to fail. In other words, if the over center latch assembly 128 were broken, lost, or dysfunctional, the inventive musical instrument stand 100 would continue to support an instrument placed within its instrument saddle support portions 170 (see FIG. 4), and preclude the instrument from being unintentionally dislodged from the inventive musical instrument stand 100.

When viewing FIGS. 1 through 6 collectively, it can be seen that in a preferred embodiment, the musical instrument stand 100 includes legs 108 and 110, secured to the support portion 104, as shown by FIGS. 1, 2, 3, 4, and 5. In one configuration of the preferred embodiment, the legs 108, 110 are disposed within the leg retention channel 118, of the support portion 104, when the support portion 104 is in a closed position and rotated into a down position, as shown by FIG. 2, from its up position as shown by FIG. 1. In an alternate configuration of the preferred embodiment, the legs 108, 110 are extracted from the leg retention channel 118 when the support portion is in the up and open position, as shown by FIG. 1. In an alternative configuration of the preferred embodiment, the legs 108, 110 are extracted from the support portion 104 when the legs 108, 110, are in a retracted position as shown by FIG. 4. That is, the legs 108, 110 are extracted from the leg retention channel 118 when the support portion 104 is in the up position, while remaining in the closed position, as shown by FIG. 4. It is noted that FIGS. 1, 5, and 6 each show the support portion 104 in the closed position, while FIGS. 2, 3, and 4 show the support portion 104 in the open position. It is also noted that the position stop 126 limits the extent to which the support portion 104 can be placed in a fully open position, as shown by FIG. 6, or a fully closed position as shown by FIG. 2.

Figure 7:
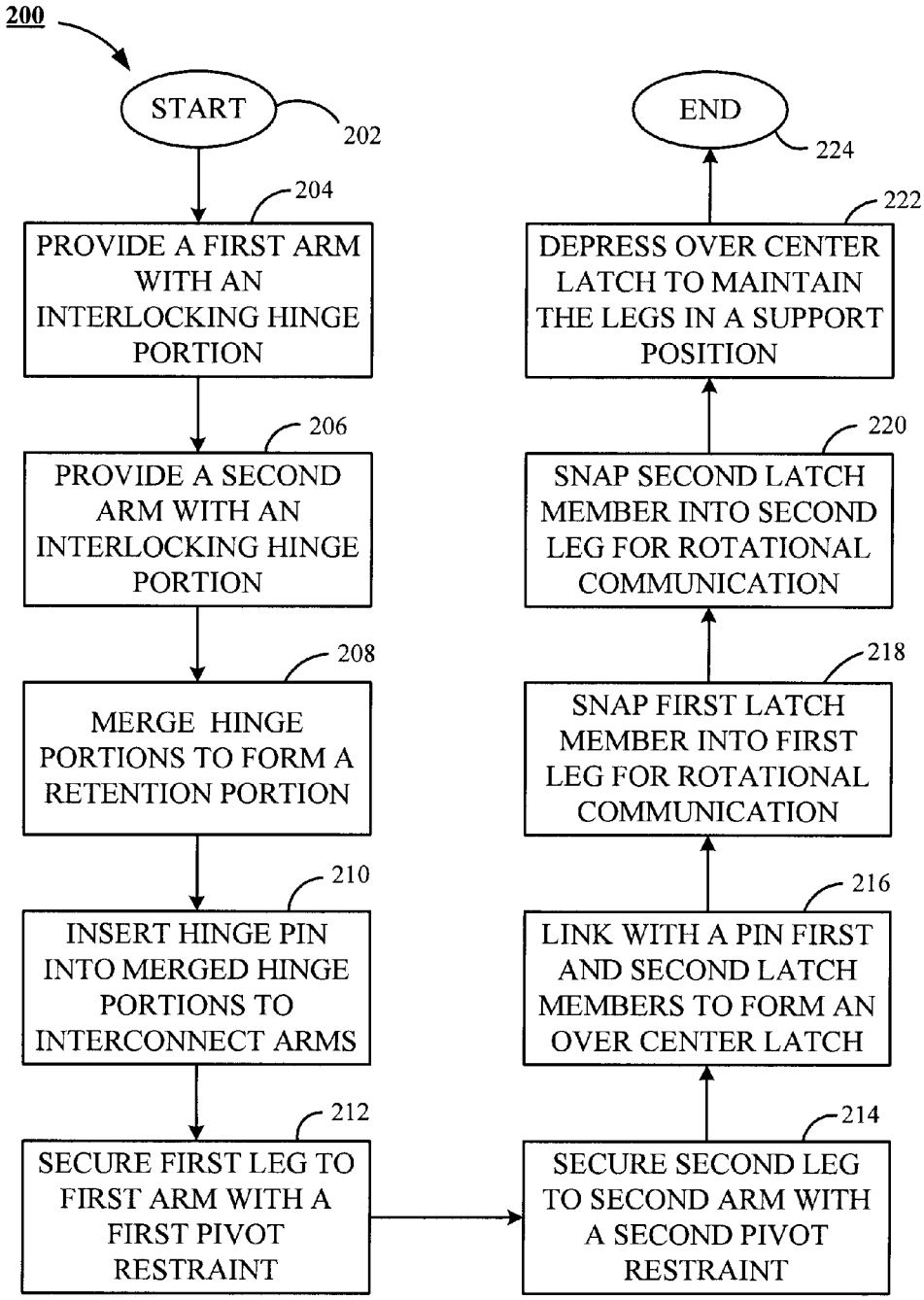
FIG. 7 shows a flowchart of a method of assembling the inventive musical instrument stand of FIG. 1.

Flowchart 200 of FIG. 7 shows method steps of a process of making an inventive musical instrument stand (such as 100). The process commences at start process step 202 and continues at process step 204. At process step 204, a first arm (such as 112) of a support portion (such as 104) is provided. In a preferred embodiment, the first arm includes a first interlocking hinge portion (such as 120). At process step 206, a second arm (such as 114) of the support portion is provided with a second interlocking hinge portion (such as 120).

The process continues at process step 208, with the merging of the first and second interlocking hinge portions to form a retention portion (such as 124). Merging of the first and second interlocking hinge portions assures that a first stop feature (such as 156) of the first arm and a second stop feature (such as 158) of the second arm interact to form a position stop (such as 126) of the support portion. At process step 210, a hinge pin (such as 122) is inserted into a hinge pin aperture (such as 136) formed by the merged first and second interlocking hinge portions. With the hinge pin in place, a first hinge, i.e., the retention portion 124 is formed. At process step 212, a first leg (such as 110) is secured to the first arm with a first of two pivot restraints (such as 106), and at process step 214, a second leg (such as 110) is secured to the second arm with the second pivot restraint.

At process step 216, a first latch member (such as 130) is linked to a second latch member (such as 132) with a latch pin (such as 134) to form an over center latch assembly (such as 128). At process step 218, the first latch member is snapped into rotational communication with the first leg, and at process step 220, the second latch member is snapped into rotational communication with the second leg. At process step 222, the over center latch is depressed to secure the first and second legs in an instrument support position, and the process concludes at end process step 224.

While preferred embodiments of the present invention are directed to a stand suitable for use in supporting a stringed instrument such as a guitar, it will be appreciated that the disclosed subject matter is not necessarily so limited. Rather, the support can be sized and configured for use in any number of applications and environments, including but not limited to use as an easel for a presentation, a book holder, a support for any number of different types of substrates (e.g., drywall), etc.

What is claimed is:

1. A musical instrument stand comprising:

a first horizontal leaf having an instrument cradle portion;

a first vertical leaf pivotally secured to the first horizontal leaf, wherein the first vertical leaf provides a stop feature, the first vertical leaf including at least a first external shell, said first external shell having a concave inner surface, a convex outer surface, and a main body disposed between the concave inner surface and the convex outer surface;

a second horizontal leaf having an instrument cradle portion; and a second vertical leaf pivotally secured to the second horizontal leaf, the second vertical leaf provides a second stop feature, and a second external shell, said second external shell having a concave inner surface, a convex outer surface, and a main body disposed between the concave inner surface and the convex outer surface, and wherein the first and second stop features interact to limit an angle between the first and second horizontal leaves, and wherein the concave inner surface, the convex outer surface, and the main body of the first vertical if collectively form an edge surface enclosing a perimeter of the first vertical leaf.

2. The musical instrument stand of claim 1, in which each said vertical leaf, further comprising:

a baffled matrix support structure, wherein the baffled matrix support structure establishes a predetermined configuration of each said vertical leaf and supports the first and second external shells;

a pivot aperture projecting through each external shell, each pivot aperture supporting a pivot restraint, wherein each pivot restraint having a portion mounted flush with their corresponding convex outer surfaces; and an instrument retention region, wherein the instrument retention region is formed from a skid resistant, elastomeric material that inhibits an inadvertent movement of a musical instrument supported by the first and second vertical leaves.

3. The musical instrument stand of claim 1, in which the two vertical leaves each have a length greater than their width, the two vertical leaves joined hingedly along their length, a spine is formed along their length by interlocking hinge portions of each said vertical leaf, and linked by a hinge pin.

4. The musical instrument stand of claim 1, in which each said instrument cradle portion of each horizontal leaf comprising a skid resistant, elastomeric material that inhibits inadvertent movement of a musical instrument cradled by each said cradle portion.

5. The musical instrument stand of claim 4, in which said skid resistant, elastomeric material of each cradle portion provides a serrated surface communicating with said musical instrument for improved retention of said musical instrument supported by said cradle portion.

6. The musical instrument stand of claim 1, in which each said horizontal leaf comprising feet on a surface facing edge having skid resistant elastomeric material.

7. The musical instrument stand of claim 1, in which each said horizontal leaf comprises a detent communicating with its corresponding vertical leaf when each said horizontal leaf is placed into a retracted position, wherein said detents inhibit a return of a support base to a closed position.

8. A musical instrument stand comprising:

a first hinge having a first latch member and a second latch member opposite each other, linked by a hinge pin, said first and second latch members each providing hinge pin apertures on their respective proximal ends, and male latch attachment members on their respective distal ends, in which said first and second hinge pin apertures interact with said hinge pin;

a first horizontal leaf coupling the first latch member;

a first vertical leaf pivotally connected to the first horizontal leaf and including at least a first concave inner surface, a first convex outer surface, and a main body portion disposed between said first concave inner surface, and said first convex outer surface;

a second horizontal leaf coupling the second latch member, and wherein said first and second male latch attachment members cooperate with corresponding first and second female latch securement members, said corresponding first and second female latch securement members provided respectively by said first horizontal leaf and said second horizontal leaf;

a second vertical leaf pivotally connected to the second horizontal leaf and including at least a second concave inner surface, a second convex outer surface, and a main body portion disposed between said second concave inner surface, and said second convex outer surface; and a second hinge having a first vertical leaf and a second vertical leaf opposite each other, linked by a hinge pin; wherein the first hinge and the second hinge defining a single plane in an open position and a closed position and operation therebetween.

9. The musical instrument stand of claim 8, in which each said horizontal leaf has feet on a surface facing edge and an instrument cradle portion on an instrument facing edge.

10. The musical instrument stand of claim 9, in which said feet on said surface facing edge of each horizontal leaf comprises skid resistant elastomeric material.

11. The musical instrument stand of claim 9, in which said instrument cradle portion of each horizontal comprising a skid resistant, elastomeric material that inhibits inadvertent movement of a musical instrument cradled by said cradle portion.

12. The musical instrument stand of claim 11, in which said skid resistant, elastomeric material of each cradle portion provides a serrated surface communicating with said musical instrument for improved retention of said musical instrument supported by said cradle portion.

13. The musical instrument stand of claim 8, in which each said vertical leaf, further comprising:

a baffled matrix support structure, wherein the baffled matrix support structure establishes a predetermined configuration of each said vertical leaf and supports the first and second concave external shells;

a pivot aperture projecting through the external shell and supporting a pivot restraint, wherein the pivot restraint having a portion mounted flush with the concave surface; and an instrument retention region, wherein the instrument retention region is formed from a skid resistant, elastomeric material that inhibits an inadvertent movement of a musical instrument supported by the first and second vertical leaves.

14. The musical instrument stand of claim 8, in which two vertical leaves joined hingedly at a spine is formed by interlocking hinge portions of each said vertical leaf, and linked by a hinge pin.

* * * * *